US006448483B1

(12) United States Patent
Loo et al.

(10) Patent No.: US 6,448,483 B1
(45) Date of Patent: Sep. 10, 2002

(54) DANCE VISUALIZATION OF MUSIC

(75) Inventors: Siang L. Loo, Lynnwood, WA (US); Jeremy A. Kenyon, Kirkland, WA (US)

(73) Assignee: WildTangent, Inc., Redmond, WA (US)

( * ) Notice: Subject to any disclaimer, the term of this patent is extended or adjusted under 35 U.S.C. 154(b) by 0 days.

(21) Appl. No.: 09/796,810

(22) Filed: Feb. 28, 2001

(51) Int. Cl.[7] ..... A63J 17/00
(52) U.S. Cl. ..... 84/464 R; 84/477 R; 434/250
(58) Field of Search ..... 84/60, 644, 645, 84/670, 718–721, 743–746, 477 R, 478, DIG. 6, 464 R, 464 A; 434/250, 307 R, 307 A, 308

(56) References Cited

U.S. PATENT DOCUMENTS 5,270,480 A * 12/1993 Hikawa ..... 84/645
5,636,994 A * 6/1997 Tong ..... 434/308
6,001,013 A * 12/1999 Ota ..... 434/250 X
6,140,565 A * 10/2000 Yamauchi et al. ..... 84/600
6,177,623 B1 * 1/2001 Ooseki ..... 84/477 R
6,225,545 B1 * 5/2001 Suzuki et al. ..... 84/477 R
6,227,968 B1 * 5/2001 Suzuki et al. ..... 434/250 X

* cited by examiner

*Primary Examiner*—Stanley J. Witkowski
(74) *Attorney, Agent, or Firm*—Columbia IP Law Group, PC

(57) ABSTRACT

An apparatus is equipped to provide dance visualization of a stream of music. The apparatus is equipped with a sampler to generate characteristic data for a plurality of samples of a received stream of music, and an analyzer to determine a music type for the stream of music using the generated characteristic data. The apparatus is further provided with a player to manifest a plurality of dance movements for the stream of music in accordance with the determined music type of the stream of music.

19 Claims, 7 Drawing Sheets

Visualization of Music in Dance Movements

304

| Sample/Spectrum | Sm-1 | | | Sm-j | | | Sm-p |
|---|---|---|---|---|---|---|---|
| Sample-1 | | | | | | | |
| | | | | | | | |
| Sample-i | | | | Iw-ij | | | |
| | | | | | | | |
| Sample-q | | | | | | | |

500

600

| Music Type $MT_i$ | M1 | M3 | M5 | M7 | M9 |
|---|---|---|---|---|---|
| M1 | | $W_{13}$ | $W_{15}$ | | |
| M3 | | | $W_{35}$ | $W_{37}$ | |
| M5 | | | | $W_{57}$ | $W_{59}$ |
| M7 | | $W_{73}$ | $W_{75}$ | | |
| M9 | $W_{91}$ | $W_{93}$ | | | |

DANCE VISUALIZATION OF MUSIC

BACKGROUND OF THE INVENTION

1. Field of the Invention

The present invention relates to the field of information processing. More specifically the present invention relates to the visualization of music.

2. Background Information

Advances in integrated circuit and computing technology have led to wide spread adoption of computing devices of various forms. Modem day computing devices, including personal ones, are often packed with processors having computing capacities that were once reserved for the most powerful "mainframes". As a result, increasing number of application user interfaces have gone multi-media, and more and more multi-media applications have become available.

Among the recently introduced multi-media applications are music visualization applications, where various animations are rendered to "visualize" music. To-date, the "visualizations" have been pretty primitive, confined primarily to basic manipulations of simple objects, such as rotation of primitive geometric shapes and the like. Thus, more advance visualizations are desired.

SUMMARY OF THE INVENTION

An apparatus is equipped to provide dance visualization of a stream of music. The apparatus is equipped with a sampler to generate characteristic data for a plurality of samples of a received stream of music, and an analyzer to determine a music type for the stream of music using the generated characteristic data. The apparatus is further provided with a player to manifest a plurality of dance movements for the stream of music in accordance with the determined music type of the stream of music.

In various embodiments, the sampler, analyzer and the player are implemented in computer executable instructions, and the apparatus may be a desktop computer, a notebook sized computer, a palm sized computer, a set top box, and other devices of the like.

DETAILED DESCRIPTION OF THE INVENTION

In the following description, various aspects of the present invention will be described. However, it will be apparent to those skilled in the art that the present invention may be practiced with only some or all aspects of the present invention. For purposes of explanation, specific numbers, materials and configurations are set forth in order to provide a thorough understanding of the present invention. However, it will also be apparent to one skilled in the art that the present invention may be practiced without the specific details. In other instances, well known features are omitted or simplified in order not to obscure the present invention.

Parts of the description will be presented in terms of operations performed by a digital system, using terms such as data, tables, determining, comparing, and the like, consistent with the manner commonly employed by those skilled in the art to convey the substance of their work to others skilled in the art. As well understood by those skilled in the art, these quantities take the form of electrical, magnetic, or optical signals capable of being stored, transferred, combined, and otherwise manipulated through mechanical and electrical components of the digital system. The term digital system includes general purpose as well as special purpose data processing machines, systems, and the like, that are standalone, adjunct or embedded.

Various operations will be described as multiple discrete steps in turn, in a manner that is most helpful in understanding the present invention, however, the order of description should not be construed as to imply that these operations are necessarily order dependent. In particular, these operations need not be performed in the order of presentation. Further, the description repeatedly uses the phrase "in one embodiment", which ordinarily does not refer to the same embodiment, although it may.

Figure 1:
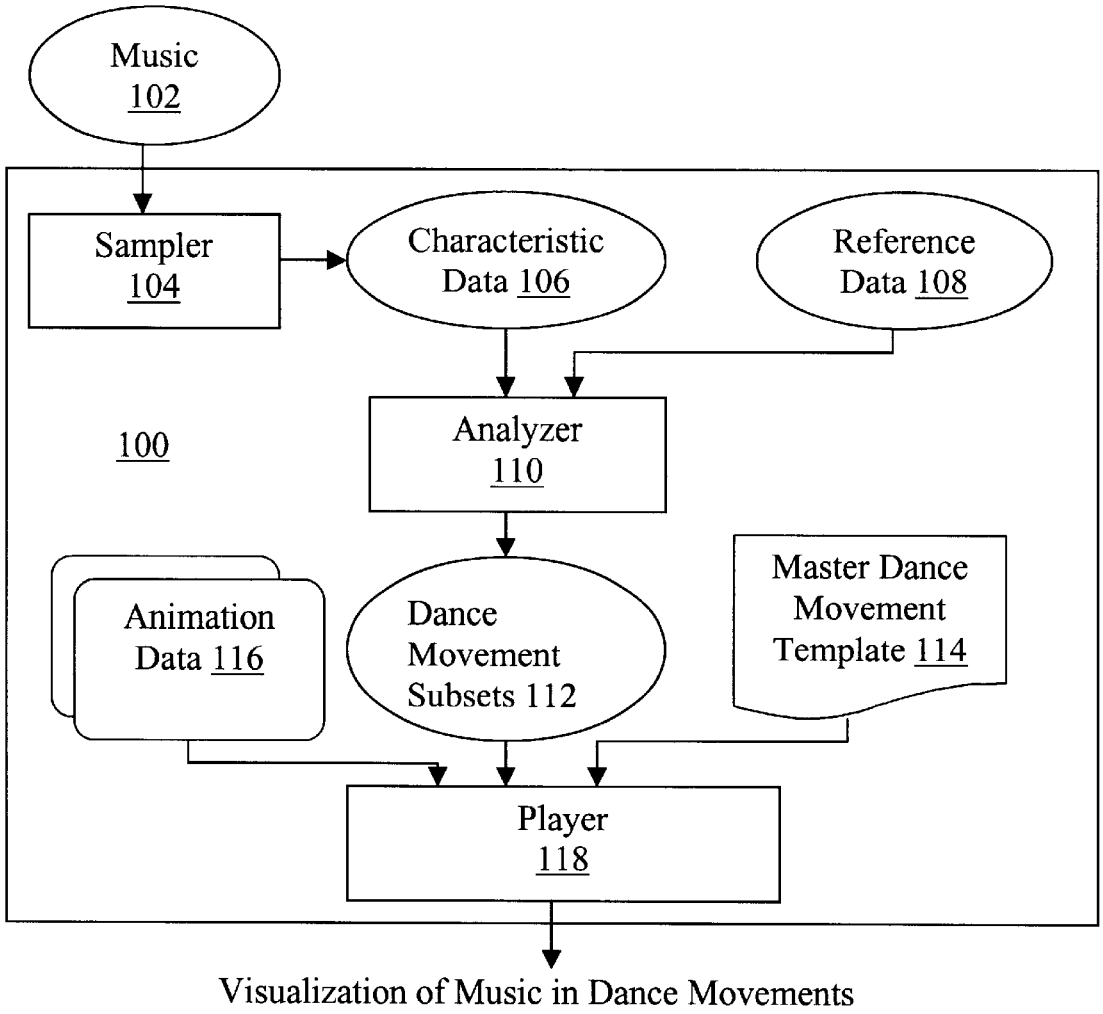
FIG. 1 illustrates a component view of the present invention, in accordance with one embodiment.
Figure 2:
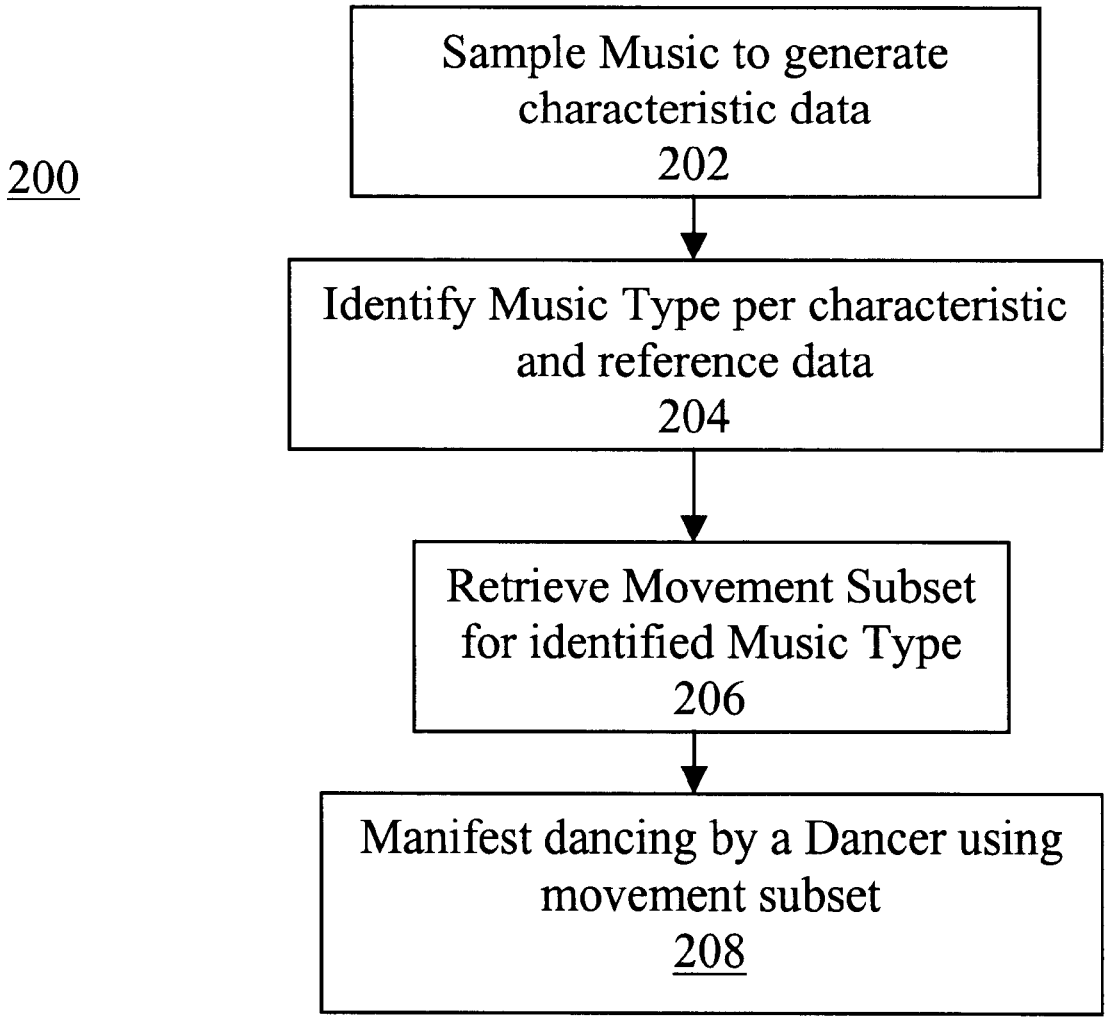
FIG. 2 illustrates a method view of the present invention, in accordance with one embodiment.

Referring now to FIGS. 1–2, wherein a component view and a method view of the present invention, in accordance with one embodiment, are illustrated, respectively. For the illustrated embodiment, as shown in FIG. 1, music visualizer 100 of the present invention, which manifests or visualizes music in the form of dance movements, includes sampler 104, analyzer 110, and player 118. Music visualizer 100 also includes reference data 108, dance movement subsets 112, master dance movement template 114, dance movement animation data 116. The elements are operationally coupled to or associated with each other as shown.

More specifically, as also illustrated by FIG. 2, sampler 104 is employed to sample a received stream of music 100, generating characteristic data 106 for a plurality of samples taken of received music stream 100 (block 202). In various embodiments, each sample is characterized by the intensity of the audio signals for a plurality of spectrums. In various embodiments, the spectrums are selected dance significant spectrums constructed from finer raw spectrums. Accordingly, for these embodiments, characteristic data 106 of the dance significant spectrums are composite intensity data derived from the intensity data of the audio signals of the underlying finer raw spectrums (to be described more fully below).

Analyzer 110 is employed to determine a music type for music 100, based on generated characteristic data 106 of the various samples (block 204). Examples of music type include but are not limited to rock and roll, country western, classical, rhythm and blues, jazz, and rap. For the illustrated embodiment, analyzer 110 makes the music type determination for music 100 referencing reference data 108 of the various music types. For the embodiments where characteristic data 106 are expressed in terms of the intensities of the audio signals (or derived composite intensities) for a number of spectrums, reference data 108 of the various music types are also similarly expressed.

The resulting music type is employed to look up or retrieve a corresponding subset of basis dance movements for the music type (block 206), from a database 112 of basis dance movements for different music types. In other words, the present invention contemplates the employment of a different set of basis dance movements to combinatorially manifest or visualize music of different types. That is, rock and roll music will have one subset of basis dance movements, while country western will have another subset of basis dance movements, and so forth. Basis dance movements may be a singular dance movement or a sequence of dance movements. Examples of singular dance movements include but are not limited to leg movement in a forward direction, leg movement in a backward direction, leg movement in rightward direction, leg movement in leftward direction, clapping of the hands, raising both hands, swaying both hands, swaying of the hip, and so forth. An example of a sequence of dance movement would be leg movement in a forward direction, followed by the clapping of the hands, and swaying of the hip. Note that while different subsets of basis dance movements are employed to manifest or visualize music 100, typically the subsets are not disjoint subsets. That is, typically, the subsets of basis dance movements of the various music types do share certain common basis dance movements, e.g. clapping of the hands.

Player 118 is then employed to manifest or visualize music 100 using the appropriate subset of basis dance movements, in accordance with the determined music type (block 208). For the illustrated embodiment, player 118 combinatorially manifests or visualizes performance the basis dance movements with the assistance of master dance movement template 114 and animation data 116.

Briefly, master dance movement template 114 is a master cyclic graph depicting the legitimate transitions between various dance movements. For the illustrated embodiment, for efficiency reason, due at least in part to the common basis dance movements between the music types, a single master movement template is employed. However, in alternate embodiments, multiple data movement templates may be employed instead.

Animation data 116 include but are not limited to 2-D or 3-D images (coupled with motion data), when rendered, manifest a dancer performing the basis dance movements (e.g. at a predetermined frame rate, such as 30 frames per sec.). In various embodiments, the dancer may be a virtual person of either gender, of any age group, of any ethnic origin, dressed in any one of a number of application dependent fashions. Alternatively, the dancer may even be a virtual animal, a cartoon character, and other "personality/characters" of like kind.

Accordingly, music 100 represents a broad range of distinguishable music types known in the art, including but are not limited to the example music types of rock and roll, country and western, and so forth enumerated above. Sampling of audio signals and generation of basic spectrum intensity data to characterize an audio sample, are both known in the art, accordingly sampler 104 and its basic operations will not be further described.

Before proceeding to further describe the remaining elements, and their manner of cooperation in further detail, it should be noted that while for ease of understand, sample 104, analyzer 110, player 116 and their associated data are illustrated as components of "a" visualizer 100, each of these constituted component and associated data, including visualizer 100 itself may be implemented as shown, or combined with one or more other elements, or distributively implemented in one or more "sub"-components.

Figures 3A, 3B:
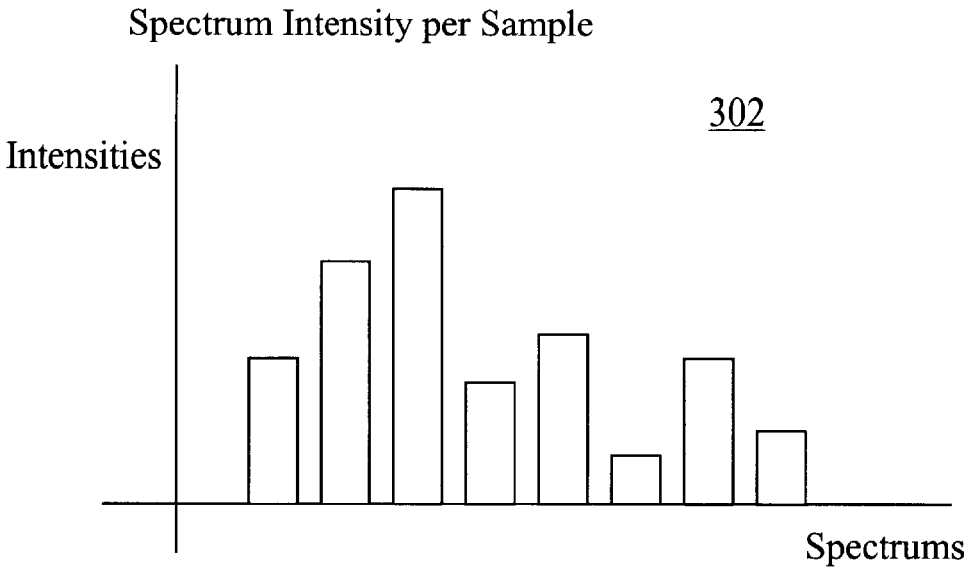
FIGS. 3*a*–3*b* illustrate a graphical and a table view of characteristic and reference data 106 and 108 of FIG., 1, in accordance with one embodiment.

FIGS. 3*a*–3*b* illustrate a graphical and a table view of characteristic data 106/108 respectively, in accordance with one embodiment. As illustrated by graphical depiction 302, and suggested earlier, for each sample of music 100, the sample may be characterized by the intensities of the audio signals of the various spectrums. These spectrum intensity characterization data may be stored using example table structure 304 of FIG. 3*b*. Table structure 304 comprises n rows and m columns for storing characteristic data for n samples, each characterized by the intensity data of m spectrums.

As alluded to earlier, preferably, the spectrums employed are dance significant spectrums constructed from finer raw spectrums. More specifically, in various embodiments, the dance significant spectrums are spectrums corresponding to certain instruments and/or voice types. Accordingly, some of dance significant spectrums may overlap. Examples of dance significant spectrums include but are not limited to instrument/voice spectrums corresponding to bass drums, snare drums, cymbals, various piano octaves, female voice octaves, male voice octaves, rap voice octaves, and digital MIDI ambient sound.

Further, as also alluded to earlier, the intensity data of the dance significant spectrums are composite intensity data derived on a weighted basis using the intensity data of the constituting finer raw spectrums. Typically, the weights of the lower frequencies are higher than the weights of the higher frequencies, although in alternate embodiments, they may not. The weights may be pre-determined based on a number of sample music pieces of the music types of interest, using any one of a number of "best fit" analysis techniques known in art (such as neural network). The number of samples as well as the number of raw and dance significant spectrums to be employed are both application dependent. Generally, the higher number of samples employed, as well as the higher number of spectrums employed, the higher the precision of the analysis would be, provided the computing platform has the necessary computing power to process the number of samples and work with the number of spectrum in real time to maintain the real time experience of music 100. Accordingly, the number of samples and spectrums employed are at least partially dependent on the processing power of the computing platform.

In alternate embodiments, other data structures may be employed to store the characteristic data of the various samples instead.

Figure 4:
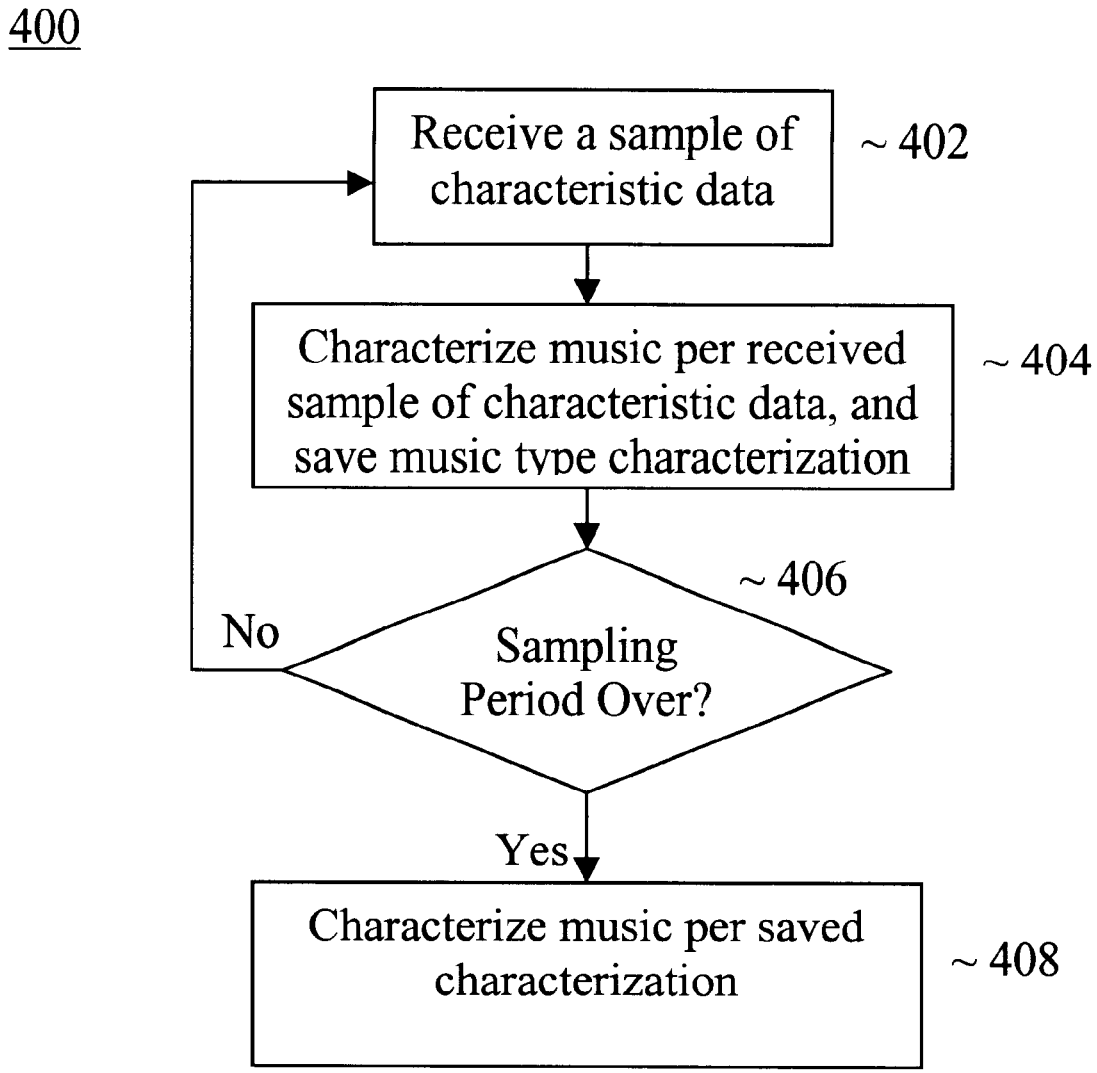
FIG. 4 illustrates the operational flow of the relevant aspects of analyzer 110 of FIG. 1 in accordance with one embodiment.

FIG. 4 illustrates operation flow 400 of the relevant aspects of analyzer 110, in accordance with one embodiment. As illustrated, at block 402, analyzer 110 receives characteristic data of a sample of music 100. Using reference data 108, analyzer 110 characterizes the music type of the received sample, block 404. In one embodiment, analyzer 110 determines the music type by comparing the characteristic data of the received sample against the reference characteristic data of the various music types, and selects the music type against whose reference characteristic data, the characteristic data of the sample bears the most resemblance. Resemblance may be determined using any one of a number of metrics known in the art, e.g. by the sum of squares of the differences between the intensity data of the various spectrums. Upon determining the music type for the sample, analyzer 110 saves and accumulates the information, block 404.

At block 406, for the illustrated embodiment, analyzer 110 determines if the sampling period is over. If not, analyzer 110 returns to block 402, and continues its processing therefrom. On the other hand, if the sampling period is over, analyzer 110 characterizes music 100 in accordance with the characterization saved for the samples taken and processed during the sampling period. In one embodiment, analyzer 110 selects the music type with the highest frequency of occurrences (when characterizing the samples) as the final characterization for music 100. In alternate embodiments, various weighting mechanisms, e.g. weighting the characterizations by the age of the samples, may also be employed in making the final music type determination for music 100.

In other embodiments, analyzer 110 repeats the process for multiple sampling periods. That is, analyzer 110 makes an initial determination based the samples taken and processed during a first sampling period, and thereafter repeats the process for one or more sample period to confirm or adjust its determination of the music type. In various embodiments, analyzer 110 repeats the process until music 100 ends.

Figures 5, 6:
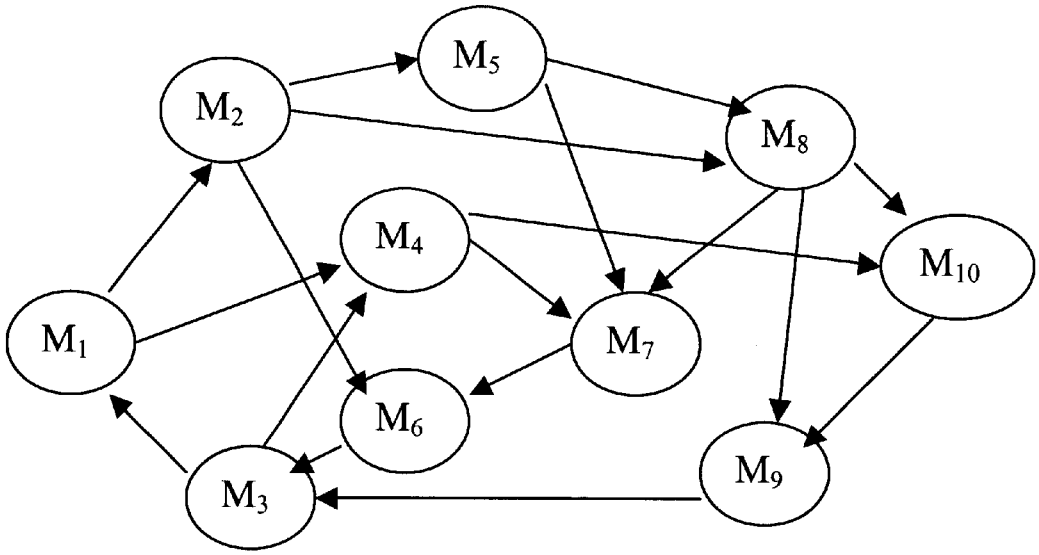
FIG. 5 illustrates master dance movement template 114 of FIG. 1 in accordance with one embodiment.
FIG. 6 illustrates a basis dance movement subset 112 of FIG. 1 in accordance with one embodiment.

FIG. 5 illustrates a graphical depiction 500 of master basis dance movement template 114, in accordance with one embodiment. As described earlier, master basis dance movement template 114 depicts the legitimate transitions between various dance movements. For example, dance movement Ml may be followed by dance movements M2 or M4, whereas dance movement M2 may be followed by M3, M5 or M8, and so forth. Whether certain dance movement transitions are to be considered legitimate or illegitimate is application dependent. Preferably, the legitimacy and illegitimacy decisions are guided by the resulting manifestations or visualizations that bear closest resemblance to how "most" dancers will dance for a type of music. However, given dancing is a form of artistic expression, by definition, except for those sequences of dance movements that are physically impossible, technically all dance movements may be deemed legitimate. In fact, for artificial personalities/characters, such as cartoon characters, even the physical impossible transitions may be considered legitimate transitions. Accordingly, the categorization of certain dance movements as legitimate (accordingly permissible), and illegitimate (accordingly, impermissible), is substantially an implementation preference.

As described earlier, for the illustrated embodiment, a single master basis dance movement template 114 is employed, although in alternate embodiments, multiple templates may be employed to practice the present invention instead.

FIG. 6 illustrates a table view 600 of a subset of basis dance movements of a music type, in accordance with one embodiment. For the illustrated embodiment, for music type $MT_i$, the basis dance movements comprise basis dance movements of M1, M3, M5, M7 and M9 of the "global" basis dance movements. Each of the Ms' denotes a singular dance movement, such as leg movement in forward direction, and so forth, or a sequence of dance movements (formed from one or more singular dance movement) as described earlier. For the illustrated embodiment, the legitimate transitions from each legitimate movement state are weighted, as denoted by "Ws" illustrated in the various cells of table 600. For examples, dance movement M1 may be transition to M3 or M5, whereas dance movement M3 may transition to dance movement M5 or M7, and so forth (for the particular music type $MT_i$). The transition from dance movement M1 to M3 or M5 is to be weighted in accordance with weights $W_{13}$ and $W_{15}$.

The basis dance movements provided for each music type, including the permissible transitions, and the weights accorded to the permissible transition, are all application dependent, and may be formed/assigned in accordance with the taste/prefernce of the application designer.

Figure 7:
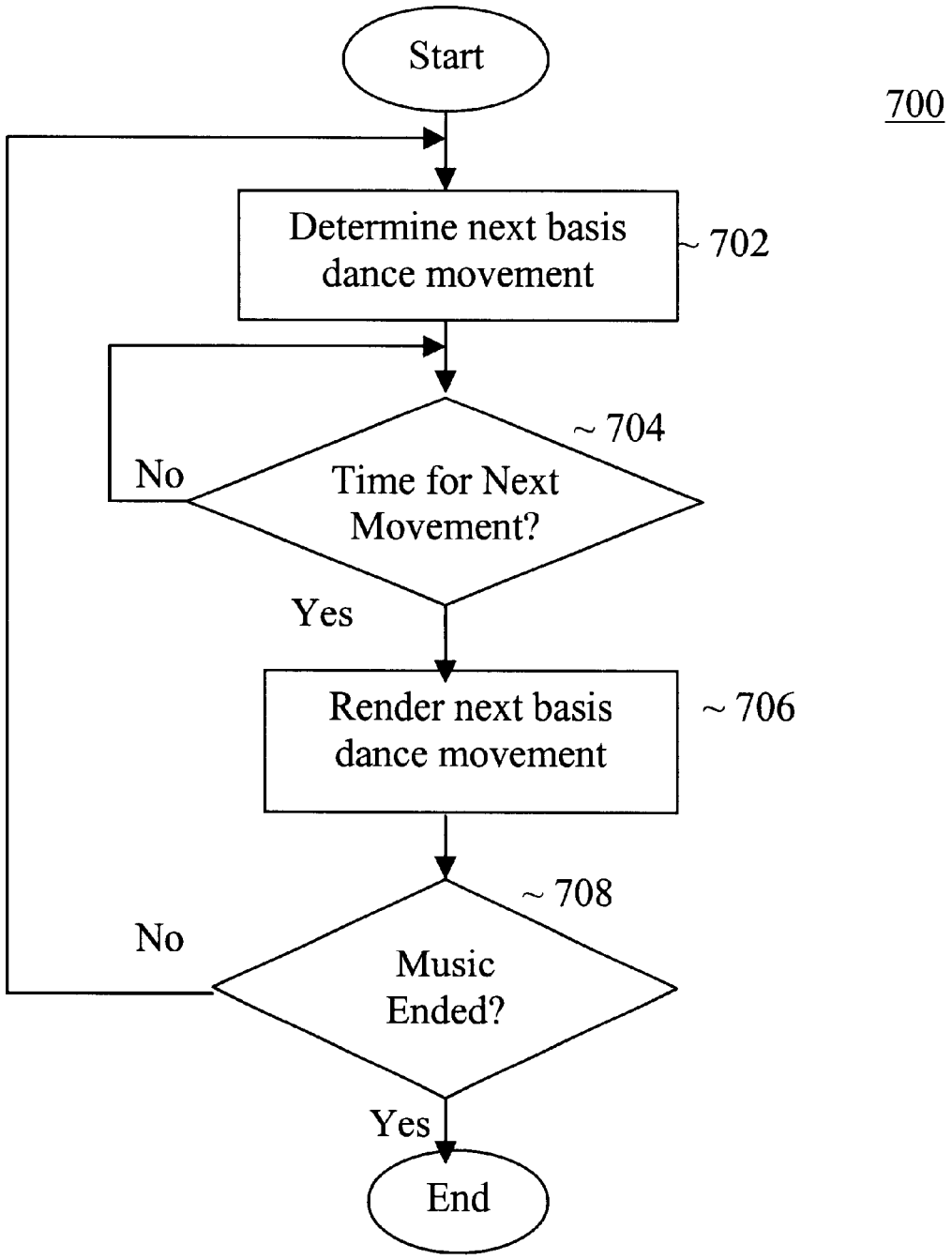
FIG. 7 illustrates the operational flow of the relevant aspects of player 110 of FIG. 1 in accordance with one embodiment.

FIG. 7 illustrates operation flow 700 of the relevant aspects of player 118, in accordance with one embodiment. As illustrated, at block 702, player 118 determines the appropriate next dance movement. For the illustrated embodiment, player 118 makes the determination in accordance with what's permissible and their assigned weights. Player 118 examines master template 114 for the global set of legitimate "next" dance movements, based on the current dance movement being animated. Initially, the dancer may be considered in a "rest" state. Player 118 particularizes or narrows the global set of legitimate "next" dance movements, in accordance with the subset of basis dance movements for the determined music type of music 100. Then, player 118 semi-probabilistically selects one of the remaining legitimate "next" dance movements, e.g. by generating a random number in a weighted manner (in accordance with the prescribed weights) and makes the selection in accordance with the generated random number. In alternate embodiments, the present invention may be practiced with the choice being made among the legitimate transitions without employing any weights. [However, as those skilled in the art will appreciate, non-employment of weights is functionally equivalent to employment of equal weights.]

At block 704, upon determining the next basis dance movement, player 118 determines whether it is time to transition to animate the next basis dance movement. If it is not time to make the transition, player 118 re-performs block 704, until eventually, it is determined that the time to make the dance movement transition has arrived. At such time, player 118 effectuates the manifestation or visualization of the next basis dance movement. As described earlier, player 118 effectuates the manifestation or visualization of the next basis dance movement, by selecting the corresponding animation data 116 and rendering them according, e.g. in the appropriate frame rate.

At block 708, player 118 determines whether music 102 has ended. If so, player 118 terminates the manifestation or visualization, e.g. by bringing the dancer to a "resting" state. However, if music 100 has not ended, player 118 returns to block 702 to determine the next basis dance movement, and continues therefrom.

Accordingly, player 118 combinatorially manifests or visualizes music 100 in the form of dance movements, in accordance with the music type of music 100.

Figure 8:
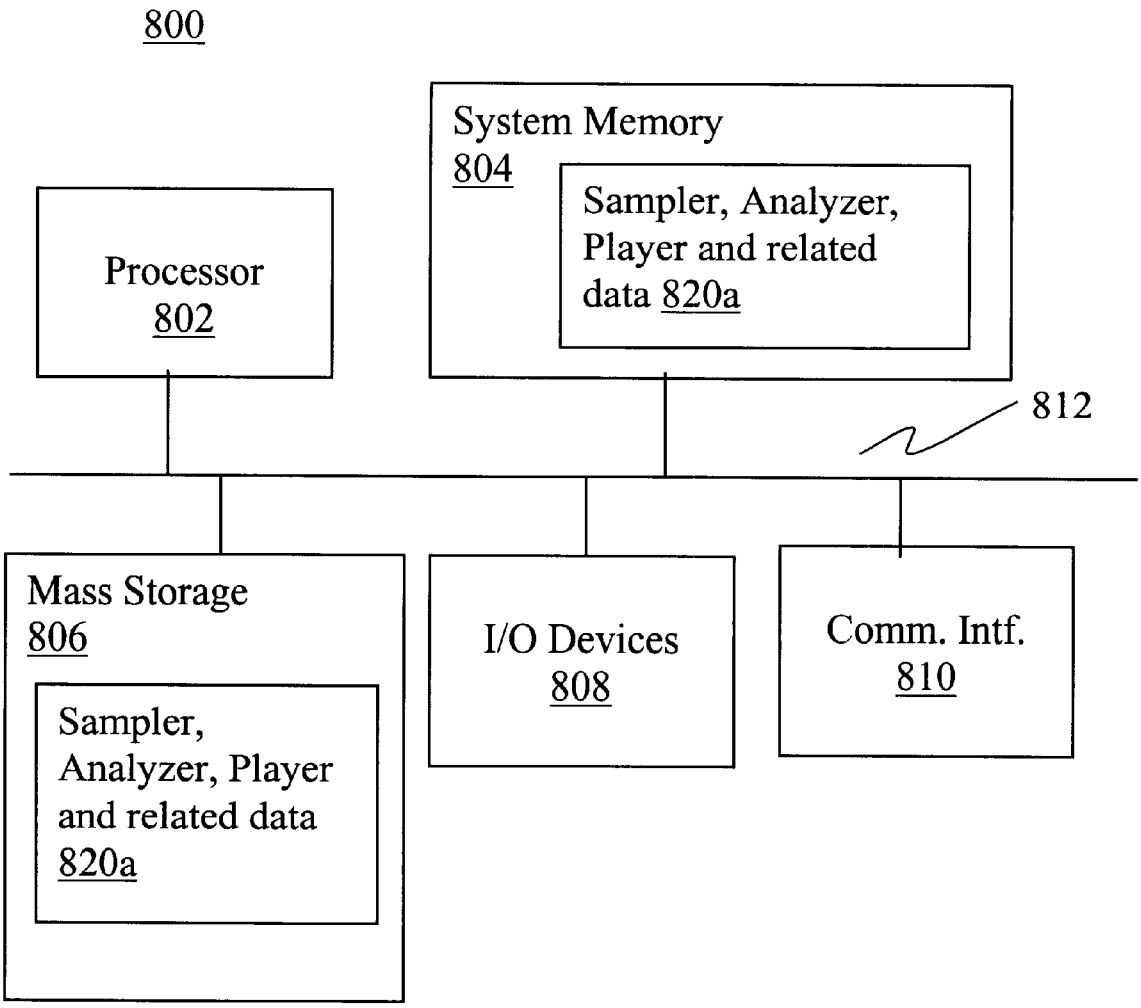
FIG. 8 illustrates a digital system suitable for practicing the present invention, in accordance with one embodiment.

FIG. 8 illustrates an example digital system suitable for use to practice the present invention, in accordance with one embodiment. As shown, digital system 800 includes one or more processors 802 and system memory 804. Additionally, digital system 800 includes mass storage devices 806 (such as diskette, hard drive, CDROM and so forth), input/output devices 808 (such as keyboard, cursor control and so forth) and communication interfaces 810 (such as network interface cards, modems and so forth). The elements are coupled to each other via system bus 812, which represents one or more buses. In the case of multiple buses, they are bridged by one or more bus bridges (not shown). Each of these elements performs its conventional functions known in the art. In particular, system memory 804 and mass storage 806 are employed to store a working copy and a permanent copy of the programming instructions implementing visualizer 100 of the present invention, including sampler 104, analyzer 110, and player 118. System memory 804 and mass storage 806 are also employed to store a working copy and a permanent copy of the associated data, such as reference data 108 and so forth. The permanent copy of the programming instructions may be loaded into mass storage 806 in the factory, or in the field, as described earlier, through a distribution medium (not shown) or through communication interface 810 (from a distribution server (not shown). The constitution of these elements 802–812 are known, and accordingly will not be further described.

Digital system 800 is intended to represent, but are not limited to, a desktop computer, a notebook sized computer, a palm-sized computing device or personal digital assistant, a set-top box, or a special application device. Further, digital system 800 may be a collection of devices, with system memory 804 representing the totality of memory of the devices, and some of the elements, such as sampler 104 and analyzer 110, executing on one device, while other elements, such as player 116, executing on another device. The two devices may communicate with each other through their respective communication interfaces and a communication link linking the two devices.

Conclusion and Epilogue

Thus, a method and apparatus for dance visualization of music has been described. Those skilled in the art will appreciate that the present invention is not limited to the embodiments described. The present invention may be practiced with modifications and enhancements consistent with the spirit and scope of the present invention, set forth by the claims below. Thus, the description is to be regarded as illustrative and not restrictive.

What is claimed is:

1. A machine implemented method comprising:

receiving a stream of music;

generating characteristic data for a plurality of samples of said stream of music;

automatically determining a music type for said stream of music based at least in part on said generated characteristic data including comparing said generated characteristic data of each of said samples of said stream of music against a plurality of reference data for a plurality of music types, and inferring the music type of said stream of music based at least in part on the results of said comparisons; and manifesting a plurality of dance movements for the stream of music in accordance with said automatically determined music type of said stream of music.

2. The method of claim 1 further comprising generating said plurality of samples, with each sample comprising intensity data for a plurality of spectrums, and said automatic determination of a music type for said stream of music comprises comparing each of said samples of spectrum intensity data against a plurality of reference spectrum intensity data for a plurality of music types, and inferring the music type of said stream of music based at least in part on the results of said comparisons.

3. The method of claim 1 wherein said manifestation of a plurality of dance movements for the stream of music in accordance with the automatically determined music type comprises rendering a plurality of visual images animating a dancer making a plurality of dance movements to the stream of music, with the dance movements corresponding to the automatically determined music type.

4. The method of claim 3 wherein the method further comprises automatically determining a plurality of basis dance movements for the automatically determined music type, and said rendering of a plurality of visual images animating a dancer making a plurality of dance movements to the stream of music comprises rendering a plurality of visual images animating a dancer combinatorially making said basis dance movements.

5. The method of claim 4 wherein said automatically determining of the basis dance movements for the automatically determined music type comprises accessing a data base of basis dance movements having stored therein a plurality of subsets of basis dance movements for a plurality of music types, and retrieving a corresponding subset of basis dance movements for the automatically determined music type.

6. The method of claim 4 wherein said rendering of a plurality of visual images animating a dancer combinatorially making said basis dance movements, is performed referencing a master dance movement template.

7. The method of claim 4 wherein the method further comprises successively determining the next basis dance movement to be animated.

8. The method of claim 7 wherein the method further comprises determining the next basis dance movement from a plurality of candidate next basis dance movements in a weighted manner.

9. The method of claim 1 further comprising automatically determining a tempo of the stream of music, and said manifestation is further performed in accordance with said automatically determined tempo of the stream of music.

10. An apparatus comprising:

storage medium having stored therein a plurality of executable instructions designed operate the apparatus to receive a stream of music, generate characteristic data for a plurality of samples of said stream of music, automatically determine a music type for said stream of music based at least in part on said generated characteristic data by comparing said generated characteristic data of each of said samples of said stream of music against a plurality of reference data for a plurality of music types, and inferring the music type of said stream of music based at least in part on the results of said comparisons, and manifest a dancer performing a plurality of dance movements for the stream of music in accordance with said automatically determined music type of said stream of music; and one or more processors coupled to the storage medium to execute the instructions.

11. The apparatus of claim 10 wherein the instructions are designed to operate the apparatus to generate said plurality of samples, with each sample comprising intensity data for a plurality of spectrums, and automatically determine a music type for said stream of music by comparing each of said samples of spectrum intensity data against a plurality of reference spectrum intensity data for a plurality of music types, and inferring the music type of said stream of music based at least in part on the results of said comparisons.

12. The apparatus of claim 10 wherein said instructions are designed to operate the apparatus to manifest a plurality of dance movements for the stream of music in accordance with the automatically determined music type by rendering a plurality of visual images animating a dancer making a plurality of dance movements to the stream of music, with the dance movements corresponding to the automatically determined music type.

13. The apparatus of claim 12 wherein the instructions are further designed to operate the apparatus to automatically determine a plurality of basis dance movements for the determined music type, and perform said rendering of a plurality of visual images animating a dancer making a plurality of dance movements to the stream of music by rendering a plurality of visual images animating a dancer combinatorially making said basis dance movements.

14. The apparatus of claim 13 wherein said instructions are designed to operate the apparatus to automatically determine the basis dance movements for the automatically determined music type by accessing a data base of basis dance movements having stored therein a plurality of subsets of basis dance movements for a plurality of music types, and retrieving a corresponding subset of basis dance movements for the determined music type.

15. The apparatus of claim 13 wherein said instructions are designed to operate the apparatus to render a plurality of visual images animating a dancer combinatorially making said basis dance movements by referencing a master dance movement template.

16. The apparatus of claim 13 wherein the instructions are further designed to operate the apparatus to successively determine the next basis dance movement to be animated.

17. The apparatus of claim 16 wherein the instructions are further designed to operate the apparatus to determine the next basis dance movement from a plurality of candidate next basis dance movements in a weighted manner.

18. The apparatus of claim 10, wherein the instructions are further designed to operate the apparatus to automatically determine a tempo of the stream of music, and perform said manifestation in accordance with said automatically determined tempo of the stream of music.

19. The apparatus of claim 10, wherein the apparatus is a selected one of a desktop computer, a notebook sized computer, a palm sized computer, and a set-top box.

* * * * *